US012465184B2

(12) United States Patent
Taylor et al.

(10) Patent No.: US 12,465,184 B2
(45) Date of Patent: Nov. 11, 2025

(54) VACUUM CLEANER

(71) Applicant: Dyson Technology Limited, Wiltshire (GB)

(72) Inventors: Mark Philip Taylor, Bristol (GB); Andrew David Chadwick, Surrey (GB); Nolan Thomas McCann, Oakton, VA (US); Mehdi Salehifar, Swindon (GB); Thomas James Richards, Swindon (GB); Angel Isidoro Nieto, Bristol (GB)

(73) Assignee: Dyson Technology Limited, Wiltshire (GB)

( * ) Notice: Subject to any disclaimer, the term of this patent is extended or adjusted under 35 U.S.C. 154(b) by 918 days.

(21) Appl. No.: 17/042,665

(22) PCT Filed: Feb. 25, 2019

(86) PCT No.: PCT/GB2019/050505
§ 371 (c)(1),
(2) Date: Sep. 28, 2020

(87) PCT Pub. No.: WO2019/186100
PCT Pub. Date: Oct. 3, 2019

(65) Prior Publication Data

US 2021/0059492 A1 Mar. 4, 2021

(30) Foreign Application Priority Data

Mar. 29, 2018 (GB) ..... 1805267

(51) Int. Cl.
*A47L 9/28* (2006.01)
*A47L 9/04* (2006.01)

(52) U.S. Cl.
CPC ..... *A47L 9/2842* (2013.01); *A47L 9/0411* (2013.01); *A47L 9/0466* (2013.01); *A47L 9/2831* (2013.01); *A47L 9/2847* (2013.01)

(58) Field of Classification Search
CPC .... A47L 9/2831; A47L 9/2847; A47L 9/2842; A47L 9/0411; A47L 9/0466; A47L 9/2889
See application file for complete search history.

(56) References Cited

U.S. PATENT DOCUMENTS 4,942,640 A * 7/1990 Hayashi ..... A47L 9/2815 15/412
5,265,305 A * 11/1993 Kraft ..... A47L 9/2857 388/815

(Continued)

FOREIGN PATENT DOCUMENTS

DE 3307002 A1 * 9/1984
DE 102011015575 A1 * 10/2012 ..... A47L 9/20

(Continued)

OTHER PUBLICATIONS

Translation of KR 940000577 Y1 (Year: 1994).*

(Continued)

*Primary Examiner* — David S Posigian
*Assistant Examiner* — Steven Huang
(74) *Attorney, Agent, or Firm* — Tucker Ellis LLP

(57) ABSTRACT

A vacuum cleaner including a cleaner head defining a suction chamber and having an agitator arranged to be rotated by an agitator motor, a dirt separator, a vacuum motor arranged to draw air into the suction chamber and then into the dirt separator, and a controller. The controller is configured to monitor the electrical load of the agitator motor, compare the magnitude of the electrical load to a threshold, and selectively adjust the electrical power delivered to the vacuum motor. The controller is configured either to increase the electrical power delivered to the vacuum (Continued)

motor to a predetermined upper power level if the electrical load is greater than the threshold, or to decrease the electrical power delivered to the vacuum motor to a predetermined lower power level if the electrical load is smaller than the threshold.

12 Claims, 6 Drawing Sheets

(56) References Cited

U.S. PATENT DOCUMENTS

| | | | | | |
|---|---|---|---|---|---|
| 5,698,957 | A | * | 12/1997 | Sowada | A47L 9/2889 318/434 |
| 5,946,770 | A | * | 9/1999 | Bijma | A47L 9/2842 15/319 |
| 2002/0112315 | A1 | * | 8/2002 | Conrad | A47L 9/2884 15/319 |
| 2002/0175646 | A1 | * | 11/2002 | Kushida | A47L 9/2805 318/268 |
| 2011/0113591 | A1 | * | 5/2011 | Mahoney, III | H02P 29/0241 15/412 |
| 2013/0207615 | A1 | * | 8/2013 | Sunderland | H01M 50/284 320/135 |
| 2014/0223688 | A1 | * | 8/2014 | Reindle | A47L 9/2894 15/383 |
| 2016/0015229 | A1 | * | 1/2016 | Conrad | A47L 9/246 15/344 |
| 2017/0000305 | A1 | | 1/2017 | Gordon et al. | |
| 2018/0255997 | A1 | * | 9/2018 | So | A47L 9/28 |
| 2020/0397204 | A1 | * | 12/2020 | Norberg | A47L 9/2805 |

FOREIGN PATENT DOCUMENTS

| | | | | | |
|---|---|---|---|---|---|
| DE | 102013205661 | A1 | * | 10/2014 | A47L 9/2842 |
| EP | 3058860 | A1 | | 8/2016 | |
| EP | 3335608 | A1 | | 6/2018 | |
| JP | S63-55797 | U | | 4/1988 | |
| JP | 2007159969 | A | * | 6/2007 | |
| JP | 2008525073 | A | * | 7/2008 | |
| JP | 2009-291223 | A | | 12/2009 | |
| JP | 2010-075612 | A | | 4/2010 | |
| JP | 2010-136906 | A | | 6/2010 | |
| JP | 2011010801 | A | * | 1/2011 | |
| JP | 5098989 | B2 | * | 12/2012 | |
| JP | 2013-074997 | A | | 4/2013 | |
| JP | 2013-226287 | A | | 11/2013 | |
| JP | 2021-516590 | A | | 7/2021 | |
| KR | 940000577 | Y1 | * | 2/1994 | |
| WO | 2014/170638 | A1 | | 10/2014 | |
| WO | WO-2016096046 | A1 | * | 6/2016 | |
| WO | 2017/004131 | A1 | | 1/2017 | |

OTHER PUBLICATIONS

Translation of JP 2007159969 A (Year: 2007).*
Translation of DE 3307002 A1 (Year: 1984).*
Translation of DE 102013205661 A1 (Year: 2014).*
Translation of JP 2011010801 A (Year: 2011).*
Translation of DE 102011015575 A1 (Year: 2012).*
Translation of JP 5098989 B2 (Year: 2012).*
Translation of JP 2008525073 A (Year: 2008).*
Sharma, "Overview of Industrial Process Automation (2nd Edition"), Published Mar. 10, 2017 (Year: 2017).*
Office Action received for Korean Patent Application No. 10-2020-7030415, mailed on Nov. 14, 2022, 10 pages (5 pages of English Translation and 5 pages of Original Document).
International Search Report and Written Opinion dated May 31, 2019, directed to PCT/GB2019/050505; 13 pages.
Search Report dated Sep. 28, 2018, directed to GB Application No. 1805267.0; 1 page.
Office Action received for Korean Patent Application No. 10-2020-7030415, mailed on Dec. 13, 2021, 10 pages (6 pages of English Translation and 4 pages of Original Document).

* cited by examiner

VACUUM CLEANER

CROSS-REFERENCE TO RELATED APPLICATIONS

This application is a national stage application under 35 USC 371 of International Application No. PCT/GB2019/050505, filed Feb. 25, 2019, which claims the priority of United Kingdom Application No. 1805267.0, filed Mar. 29, 2018.

FIELD OF THE DISCLOSURE

The present invention relates to a vacuum cleaner.

The invention is not limited to any particular type of vacuum cleaner. For example, the invention may be utilised on upright vacuum cleaners, cylinder vacuum cleaners or handheld or 'stick' vacuum cleaners.

BACKGROUND OF THE DISCLOSURE

Some known vacuums have a cleaner head which defines a suction chamber within which a motor-driven rotating agitator is provided. Such agitators often take the form of a brush bar with bristles which are arranged to agitate carpet fibres during rotation of the brush bar so as to loosen dirt therefrom. However, generally speaking the action of such an agitator is redundant when vacuum cleaning a 'hard floor' such as a section of laminate flooring. Indeed, in some cases the rotating action of an agitator can mark or scratch such a floor. Even where the agitator is designed to avoid damaging hard floors, some users perceive an agitator scrubbing a hard floor with significant force to be underisable.

Cleaner heads with suction chambers and rotating agitators generally have a suction opening, leading to the suction chamber, provided in a sole plate on the underside of the cleaner head. In use, air with entrained dirt is drawn into the suction chamber through the suction opening, before then being ducted to a dirt separator. The sole plate is generally positioned to contact the surface being cleaned or be spaced apart therefrom by a short distance, so as to increase the extent to which dirt on the surface is entrained in the airflow passing through the suction opening. Due to the low pressure in the suction chamber, this results in a tendency for the cleaner head to be sucked down onto the surface being cleaned. This action is innate in many cleaner heads, and indeed in some cases is actively encouraged so that the agitator is sucked down against the floor surface so as to provide a stronger agitating action. In either case, this can exacerbate the problem of damage (or perceived risk of damage) to hard floors from the agitator.

Some vacuum cleaners address this problem by allowing the user to switch off the agitator motor. However, this places considerable burden on the part of the user in that they must remember to, and take the time to, turn the agitator on and off when changing between carpet and hard floors. This drawback can be particularly onerous on handheld or stick vacuum cleaners. These are often battery powered, with an on/off switch which must be held in order to keep the vacuum cleaner turned on (in the manner of a 'dead man's handle'). They are usually used in 'point and shoot' fashion—holding the on/off switch on to clean a small area of a floor surface, then releasing the on/off switch and lifting the vacuum cleaner, before directing the vacuum cleaner to a different area of the floor surface and holding the on/off switch again. When a vacuum cleaner is used in such a fashion, the user would need to choose whether or not to activate/deactivate the agitator motor each time they hold the on/off switch, which can be particularly annoying, time consuming and/or prone to being forgotten.

It is an object of the invention to mitigate or obviate the above disadvantages, and/or to provide an improved or alternative suction nozzle or vacuum cleaner.

SUMMARY OF THE DISCLOSURE

According to the present invention there is provided a vacuum cleaner comprising a cleaner head defining a suction chamber and having an agitator arranged to be rotated by an agitator motor; a dirt separator; a vacuum motor arranged to draw air into the suction chamber and then into the dirt separator; and a controller configured to monitor the electrical load of the agitator motor, compare the magnitude of the electrical load to a threshold, and selectively adjust the electrical power delivered to the vacuum motor, wherein the controller is configured either to increase the electrical power delivered to the vacuum motor to a predetermined upper power level if the electrical load is greater than the threshold, or to decrease the electrical power delivered to the vacuum motor to a predetermined lower power level if the electrical load is smaller than the threshold.

This may allow the vacuum cleaner to adapt to different floor types so as to maximise overall cleaning performance. For instance, the threshold may be selected such that the electrical load of the agitator motor is above the threshold when the cleaner head is on a carpet (due to the increased frictional resistance to rotation of the agitator which is exerted by the carpet fibres), and is below the threshold when the cleaner head is on a hard floor. In such a case, the electrical power delivered to the vacuum motor would be increased when the cleaner head was on carpet (which may improve dirt pickup therefrom), and/or would be reduced when the cleaner head was on a hard floor (at which point the real or perceived risk of the agitator being forced against the surface and damaging it would be reduced, and power consumption could be reduced without excessive loss in cleaning performance since the suction required for satisfactory pickup on hard floors is generally lower).

This behaviour, increasing the suction power when the cleaner head is on a carpet and/or reducing suction power when the cleaner head is on a hard floor, is counter-intuitive. As discussed above, cleaner heads have a tendency to suck themselves down when the pressure in the suction chamber is low (i.e. when the level of suction is high). On a carpeted surface this can increase the level of sealing between the sole plate and the carpet, which further reduces the pressure in the suction chamber (due to the reduced airflow into the suction opening), which sinks the cleaner head further down and increases the level of sealing between carpet and sole plate, and so on. This leads to a phenomenon known as 'limpetting', where the cleaner head sucks itself onto the carpet with such force that it is difficult for the user to move. Accordingly, at the present time it is usually considered desirable to decrease suction when the cleaner head is on a carpet so as to reduce the risk of limpetting, and/or increase suction when the cleaner head is on a hard floor (so as to improve pickup) since the risk of limpetting on a hard floor is generally low.

The controller may be configured both to increase the power delivered to the vacuum motor to the upper power level if the electrical load is greater than the threshold, and to decrease the power delivered to the vacuum motor to the lower power level if the electrical load is smaller than the threshold.

This may be beneficial in that both the functionalities described above (improving pickup on carpet floors, and reducing power consumption and risk of damage on hard floors) can be provided.

Whilst this dual functionality is preferred, a vacuum cleaner according to the invention may nonetheless have a controller which is configured only to selectively increase the power delivered to the vacuum motor to the upper power level, or configured only to selectively decrease the power delivered to the vacuum motor to the lower power level.

Preferably, the controller can be set to supply to the vacuum motor no other power level except the upper power level and the lower power level.

This may allow the behaviour of the vacuum cleaner to be advantageously easily understood by a user (for example the user could easily understand that the vacuum cleaner switches between a 'hard floor mode' and a 'carpet mode', whereas more complex behaviour may be confusing). Instead or as well, it may allow the controller to utilise computationally cheap programming an architecture, which may reduce the cost of the vacuum cleaner.

The controller may be permanently set to supply only the upper power level and lower power level, or may be set to do so in one mode but be set to supply one or more alternative or additional power levels when in a different mode.

The controller may be configured to continue monitoring the electrical load of the agitator after making an adjustment to the power delivered to the vacuum motor, and to make a further adjustment upon detecting that the electrical load of the agitator motor has crossed over the threshold. This may be beneficial in allowing the vacuum cleaner to repeatedly adapt to changing circumstances, rather than only adapting once.

For example, the controller may be configured to increase the power delivered to the vacuum motor to the upper power level (due to the agitator motor load being above the threshold), then subsequently decrease the power supplied to the lower power level after the agitator motor electrical load has crossed the threshold and dropped beneath it. As another example, instead of or preferably as well as the above functionality, the controller may be configured to decrease the power delivered to the vacuum motor to the lower power level (due to the agitator motor load being below the threshold), then subsequently increase the power supplied to the vacuum motor to the upper power level after the agitator motor electrical load has crossed the threshold and risen above it.

The controller may be configured to monitor the agitator motor electrical load in terms of the current draw of the electrical motor, and compare the current detected to a current threshold.

This may be beneficial in that current draw of the agitator motor is generally approximately proportional to the torque experienced by the agitator, and may therefore give a particularly easily interpreted indication of the resistance exerted on the agitator by the floor surface (and thus of the type of floor surface).

In contrast, if the controller monitored the agitator motor electrical load in terms of the power draw, for example, this could be affected by variations in voltage (for instance due to variation in mains supply, or due changing state of charge of a battery pack powering the vacuum cleaner). Interpretation of the electrical load could therefore be more difficult or less reliable.

The controller may be configured to retain a record of the power level that was being delivered to the vacuum motor when the vacuum cleaner was last turned off, and configured to resume delivery of that power level to the vacuum motor when the vacuum cleaner is next turned on.

In other words, the vacuum cleaner may be arranged to 'pick up where it left off' in terms of the power delivered to the vacuum motor when the vacuum cleaner is switched off and then on again. This may be particularly beneficial in arrangements where the vacuum cleaner is likely to be turned off and on again on the same surface during a single cleaning session, in that the controller is not required to re-adjust the power level each time the vacuum cleaner is turned off and then on.

The vacuum cleaner may comprise an on/off switch which must be held in order to keep the vacuum cleaner turned on. For example, the on/off switch may take the form of a trigger which turns the vacuum cleaner on when pulled and which automatically resets and turns the vacuum cleaner off when released.

The vacuum cleaner 'picking up where it left off' may be particularly beneficial where such an on/off switch is used, since such a vacuum cleaner is generally turned off several times during cleaning of a single floor surface (for instance when lifting the vacuum cleaner to direct it towards different parts of the floor surface).

The controller may be configured to deliver a predetermined initial power level, which does not correspond to the upper power level or the lower power level, to the vacuum motor when the vacuum cleaner is turned off and then on again.

In other words, the controller may be configured to deliver the initial power level to the vacuum motor whenever the vacuum cleaner is turned on, regardless of the power level being delivered when the vacuum cleaner was last turned off. This may be particularly beneficial in arrangements where the vacuum cleaner is likely to be turned on and then not turned off again until a room has been cleaned, in that the controller does not 'presume' that the cleaner head is on the same type of surface as it was when the vacuum cleaner was last used.

The initial power level may be, for example, higher than the lower power level and lower than the upper power level. This may be beneficial in that the vacuum cleaner can start operation at a power level which is a 'happy medium' between the upper and lower power levels. This could, for example, avoid the vacuum cleaner being turned on with the upper power level being delivered to the vacuum motor and the cleaner head resting on a hard floor (whereupon damage to the floor may result, as outlined above), and/or avoid the vacuum cleaner being turned on with the lower power level being delivered to the vacuum motor and the cleaner head resting on a carpet (whereupon initial pickup may be unacceptably poor).

As an alternative, the initial power level may be lower than the lower power level (which may eliminate the risk of the cleaner head being sucked down onto a hard floor hard enough to cause damage), or higher than higher power level (which nay eliminate the risk of initial pickup being unacceptably low).

As another alternative, the controller may be configured to deliver the upper power level to the vacuum motor whenever the vacuum cleaner is turned on, or may be configured to deliver the lower power level to the vacuum motor whenever the vacuum cleaner is turned on, regardless of the power level being delivered when the vacuum cleaner was last turned off.

The controller may be configured to adjust the power delivered to the vacuum motor to the upper or lower power level gradually.

A change in the power delivered to the vacuum motor of a vacuum cleaner can often result in a perceptible change in the tone of the noise generated by the vacuum cleaner. Such a change can be perceived by the user, who may interpret a sudden change in tone as an indication of an error. A gradual change in power level may therefore make the change in tone sufficiently gradual to be imperceptible, or may be perceptible but more clearly associated with a deliberate change in behaviour rather than an error.

Although this functionality is preferable, in some embodiments the controller may be configured to adjust the power delivered to the vacuum motor to the upper or lower power level as a step change.

Where the power delivered to the vacuum motor is adjusted gradually, the controller may be configured to adjust the power delivered to the vacuum motor to the upper or lower power level over a time of at least 0.1 seconds or at least 0.2 seconds. For example, the controller may be configured to adjust the power delivered to the vacuum motor to the upper or lower power level over a time of at least 0.5 seconds.

The controller is preferably at least configured to adjust the power delivered to the vacuum motor to the upper or lower power level over a time of at least 1 second or at least 2 seconds.

This relatively long duration of change in power level may improve the chances of the change going unnoticed by the user or being recognised by the user as being deliberate.

The controller may be configured to adjust the power delivered to the vacuum motor to the upper or lower power level over a time of no more than 10 seconds or no more than 8 seconds. For example, the controller may be configured to adjust the power delivered to the vacuum motor to the upper or lower power level over a time of no more than 6 seconds.

The controller is preferably configured to adjust the power delivered to the vacuum motor to the upper or lower power level over a time of no more than 5 seconds or no more than 4 seconds.

This may allow the vacuum cleaner to adapt relatively swiftly to changes in floor type, while nonetheless adjusting the power level gradually.

The controller may further be configured to compare the magnitude of the electrical load to a spike threshold which is higher than said threshold, and to decrease the power delivered to the vacuum motor if the electrical load is larger than the spike threshold.

There is a risk that in some circumstances the agitator of a cleaner head can become tangled and forcibly stopped (for instance if a user vacuums up a corner of a rug, or if the cleaner head limpets and the agitator is pressed against a carpet with great force). This results in a peak in current running through the agitator motor and associated wiring which can be high enough to cause damage to the cleaner head. A protecting circuit can be provided (for instance inside the agitator motor) which cuts power to the agitator motor if current gets high enough, so as to reduce the risk of such damage occurring. This is known as the agitator having 'stalled'. While an agitator stalling is better than damage occurring, it can cause confusion on the part of the user as to why the agitator has stopped, or can lead to the user continuing use of the vacuum cleaner with the agitator not rotating (and cleaning performance therefore being reduced).

By reducing the electrical power delivered to the vacuum motor if the electrical load of the agitator motor is above the spike threshold, the chances of an agitator stalling (or damage occurring due to excess current) can be reduced. Reducing the power delivered to the vacuum motor can reduce the suction power, leading to a rise in pressure in the suction chamber. This, in turn, would allow the cleaner head to lift up slightly, thereby mitigating the problem if the peak in agitator motor current is due to the agitator being forced against the floor surface. Instead or as well, the reduction in suction power can make it easier for a user to pull a corner of a rug or suchlike from the cleaner head so as to allow the agitator to move freely again.

The controller may be configured to decrease the power delivered to the vacuum motor to a power level which is equal to or lower than the lower power level if the electrical load is larger than the spike threshold. This may further increase the chances of stalling of the agitator (or excessive current causing damage) being avoided for the reasons given above.

As one alternative, the controller may be configured to decrease the power delivered to the vacuum motor to a power level which is above the lower power level but below the upper power level.

The controller may be configured to decrease the power delivered to the vacuum motor, in response to the electrical load being larger than the spike threshold, as a step change.

Such a stepwise change in electrical power delivered to the vacuum motor can lead to a rapid reduction in suction power, thereby allowing advantageously swift instigation of the above mechanisms by which stalling (or damage) can be prevented.

As an alternative, the decrease in power delivered may be gradual, in which case the decrease preferably takes place over a relatively short time (for instance less than 1 seconds or less than 0.5 seconds).

The threshold may be a discrete value.

This may allow the architecture and programming of the controller to be relatively simple, since it need only compare the measured agitator motor load to a single threshold value. This, in turn, may reduce the overall cost of the vacuum cleaner.

As an alternative, the threshold may be a numerical range, the controller being configured to increase the electrical power delivered to the upper power level if the electrical load is greater than the upper limit of the threshold range, and/or to decrease the electrical power to the predetermined lower power level if the electrical load is smaller than the lower limit of the threshold range. This may be beneficial in that it could provide a 'buffer region' between the points at which the controller may adjust the power level. This, in turn, may increase the ability of the vacuum cleaner to tolerate fluctuations in agitator motor electrical load, which occur while the cleaner head is on a single surface type, without the controller changing power level.

The controller may be configured to adjust the power delivered to the vacuum motor in said manner when the controller is in a first mode, and the controller may have a second mode.

This may allow the user to override the functionality described above, if this is desired.

The controller may be configured to supply a single predetermined power level to the vacuum motor when the controller is in the second mode.

This may allow the user to set the power level delivered to the vacuum motor according to a specific use. For instance, a user may wish to clean a hard floor such as a laminate floor with the vacuum motor applying maximum suction (i.e. maximum power delivered to the vacuum motor) so as to maximise pickup of debris from between adjacent boards of laminate. As another example, a user may wish to clean a particularly delicate rug with the vacuum motor applying a low level of suction (i.e. a low power level being delivered thereto).

As an alternative, the controller may adjust the power delivered to the vacuum motor when in the second mode, but may do so in a different manner to that described above.

The controller may further have a third mode. For example, the controller may be configured to adjust the power delivered to the vacuum motor in the above described fashion when in a 'mid' mode, and the controller may have a 'min' mode in which the power level supplied to the vacuum motor is relatively low (for instance the same as or lower than the lower power level) and a 'max' mode in which the power level supplied to the vacuum motor is relatively high (for instance the same as or higher than the higher power level).

The vacuum cleaner preferably comprises a battery pack which has one or more cells that are configured to supply electrical power to the vacuum motor. The invention may be of particular benefit when applied to battery powered vacuum cleaners since the reduction in energy use described above would equate to longer battery life.

As an alternative, the vacuum cleaner may comprise a power cable for connection to a mains supply.

The agitator motor is preferably positioned partially or fully inside the agitator. This may provide an advantageously compact arrangement, and/or may allow an advantageously simple or rugged transmission mechanism to be used to transmit torque from the motor to the agitator.

The controller may be configured to monitor the electrical load of the agitator motor continuously. Alternatively, the controller may be configured to monitor the electrical load of the agitator motor periodically. In the latter case the controller may measure the electrical load with a time period of 5 seconds or less, or instance a time period of 2 seconds or less, or a time period of 1 second or less. This relatively frequent monitoring can improve the response time of the vacuum cleaner's adjustment of vacuum motor power level.

The controller may be a single unit such as a PCB. Alternatively, the controller may be made up of a plurality of sub-units. For instance the controller may comprise a sub-unit configured to control the power level supplied to the vacuum motor, a separate sub-unit configured to monitor the electrical draw of the agitator motor, and a further sub-unit receiving signals from said sub-units and sending instructions thereto.

The controller may be configured to supply electrical power to the agitator motor, or alternatively electrical power may be supplied to the agitator motor by a separate component (for instance a second controller) and the controller may be arranged solely to measure the electrical load of the motor supplied thereby.

The controller may be provided in a main body of the vacuum cleaner (for example the controller may be mounted on the vacuum motor). This may allow the same controller to be used with a plurality of interchangeable cleaner heads.

BRIEF DESCRIPTION OF THE FIGURES

Embodiments of the present invention will now be described, by way of example only, with reference to the accompanying drawings in which.

DETAILED DESCRIPTION OF THE DISCLOSURE

Figure 1:
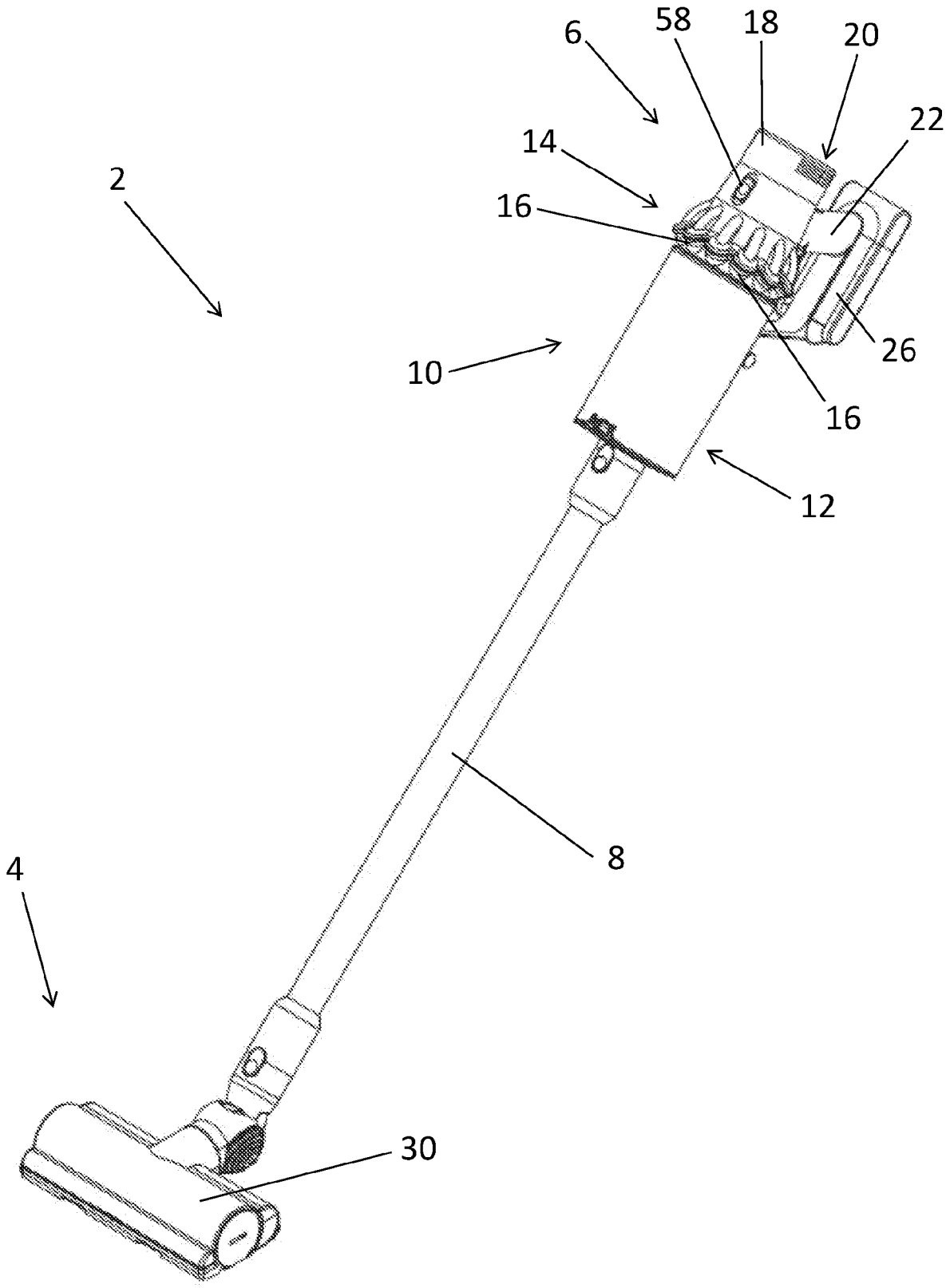
FIG. 1 is a perspective view of a vacuum cleaner according to a first embodiment of the invention.

Throughout the description and drawings, corresponding reference numerals denote corresponding features.

FIG. 1 shows a vacuum cleaner 2 according to a first embodiment of the invention. The vacuum cleaner 2 of this embodiment is a 'stick' vacuum cleaner. It has a cleaner head 4 connected to a main body 6 by a generally tubular elongate wand 8. The cleaner head 4 is also connectable directly to the main body 6 to transform the vacuum cleaner 2 into a handheld vacuum cleaner.

The main body 6 comprises a dirt separator 10 which in this case is a cyclonic separator. The cyclonic separator has a first cyclone stage 12 comprising a single cyclone, and a second cyclone stage 14 comprising a plurality of cyclones 16 arranged in parallel. The main body 6 also has a removable filter assembly 18 provided with vents 20 through which air can be exhausted from the vacuum cleaner 2.

In this case the main body 6 of the vacuum cleaner 2 has a pistol grip 22 positioned to be held by the user. At an upper end of the pistol grip 22 is an on/off switch in the form of a trigger (not visible) which must be held (i.e. 'pulled') in order to keep the vacuum cleaner turned on. As soon as the user releases the trigger, the vacuum cleaner is turned off. Positioned beneath a lower end of the pistol grip 22 is a battery pack 26 which comprises a plurality of rechargeable cells (not visible). A controller in the form of a PBC (not visible), and a vacuum motor (not visible) comprising a fan driven by an electric motor are provided in the main body 6 behind the dirt separator 10.

Figure 2:
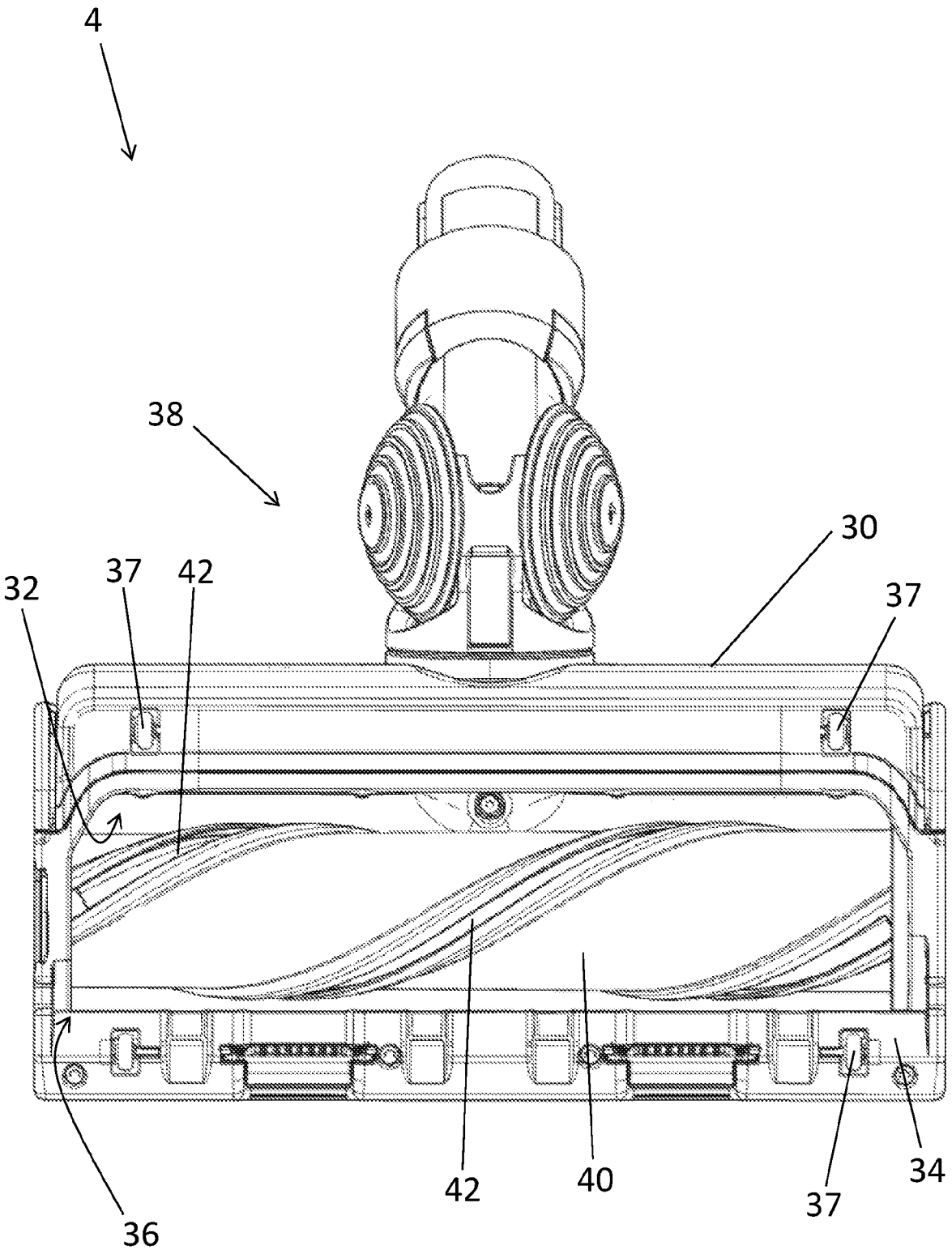
FIG. 2 is a view of a cleaner head of the vacuum cleaner of FIG. 1, shown from underneath.

The cleaner head 4 is shown from underneath in FIG. 2. The cleaner head 4 has a casing 30 which defines a suction chamber 32 and a sole plate 34. The sole plate 34 has a suction opening 36 through which air can enter the suction chamber 32, and wheels 37 for engaging a floor surface. The casing 30 defines an outlet 38 through which air can pass from the suction chamber 32 into the wand 6.

Positioned inside the suction chamber 32 is an agitator 40 in the form of a brush bar. The agitator 40 can be driven to rotate inside the suction chamber 32 by an agitator motor (not visible). The agitator motor of this embodiment is received inside, more specifically fully inside, the agitator 40. The agitator 40 has helical arrays of bristles (not shown) projecting from grooves 42, and is positioned in the suction chamber such that the bristles project out of the suction chamber 34 through the suction opening 36.

Figure 3:
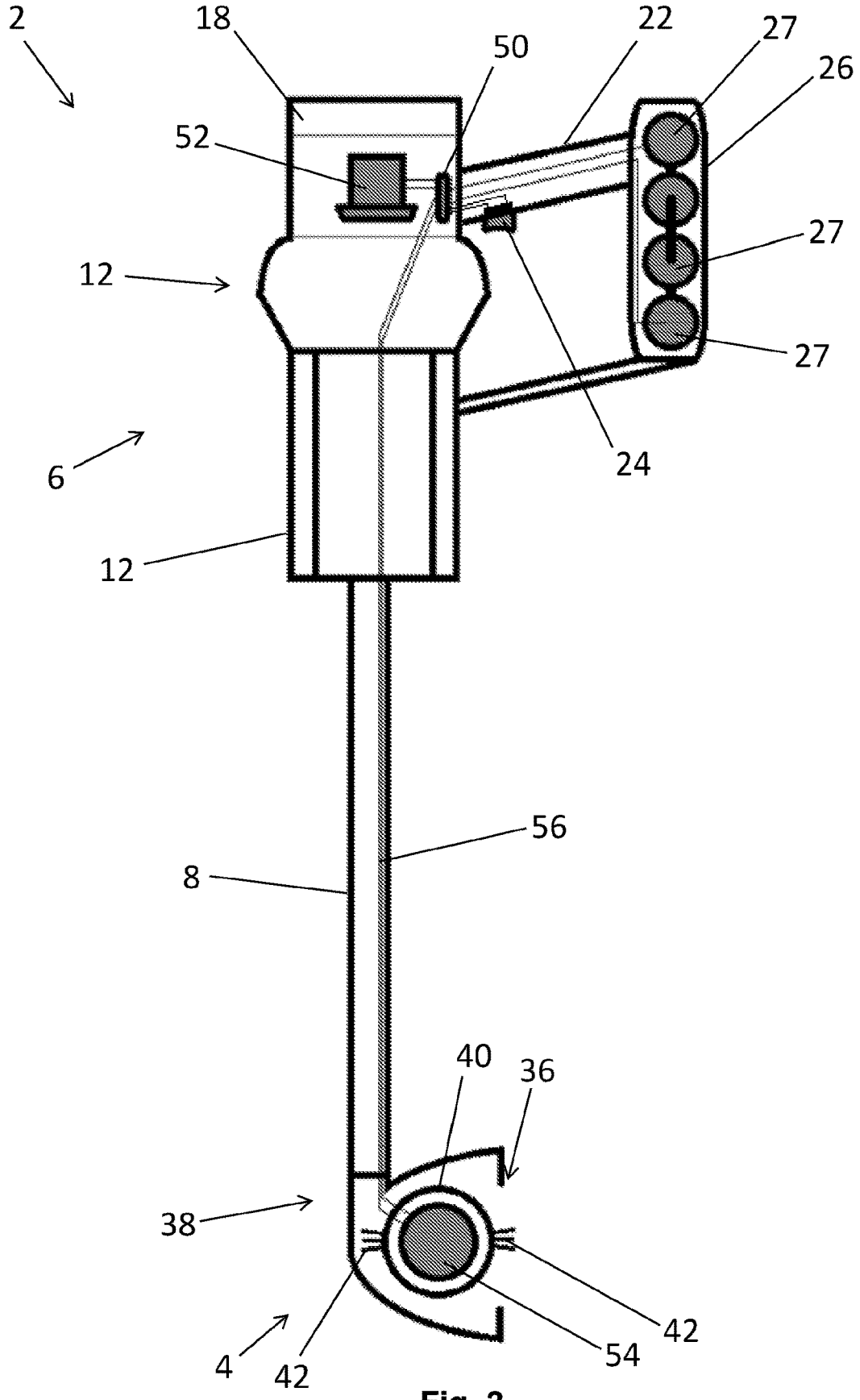
FIG. 3 is a schematic illustration of electrical components of the vacuum cleaner of FIG. 1.

FIG. 3 is a schematic representation of the electrical components of the vacuum cleaner 2, in which the trigger 24, the cells 27 of the battery pack 26, the bristles 43 of the agitator 40, the controller 50, the vacuum motor 52 and the agitator motor 54 are visible. Basic operation of the vacuum cleaner will now be described with reference to FIG. 3 in combination with FIGS. 1 and 2.

When the user pulls the trigger 24, the controller 50 supplies electrical power from the cells 27 of the battery pack 26 to the vacuum motor 52. This creates a flow of air through the machine so as to generate suction. Air with dirt entrained therein is sucked into the cleaner head 4, into the suction chamber 32 through the suction opening 36. From there, the air is sucked through the outlet 38 of the cleaner head 4, along the wand 6 and into the dirt separator 10. Entrained dirt is removed by the dirt separator 10 and then the relatively clean air is drawn through the vacuum motor, through the filter assembly 18 and out of the vacuum cleaner 2 through the vents 20.

In addition, when the trigger 24 is pulled the controller 50 also supplies electrical power from the battery pack 26 to the agitator motor 54, through wires 56 running along the inside of the wand, so as to rotate the agitator 40. When the cleaner head 4 is on a hard floor, it is supported by the wheels 37 and the sole plate 34 and agitator 40 are spaced apart from the floor surface. When the cleaner head 4 is resting on a carpeted surface, the wheels 37 sink into the pile of the carpet and the sole plate 34 (along with the rest of the cleaner head 4) is therefore positioned further down. This allows carpet fibres to protrude towards (and potentially through) the suction opening 36, whereupon they are disturbed by bristles 42 of the rotating agitator 40 so as to loosen dirt and dust therefrom.

The controller 50 monitors the electrical load of the agitator motor 54, compares the magnitude of the electrical load to a threshold, and selectively adjusts the electrical power delivered to the vacuum motor 52 as a result. In this case, the controller monitors the electrical load in terms of the current draw of the agitator motor 54, and compares this to a current threshold. The current threshold in this embodiment is a range, from 1.5 A to 2 A. The operation of the controller 50 will now be described in more detail with reference to FIGS. 1 to 3 in combination with FIG. 4, which is a flow chart showing the decision steps and actions performed by the controller 50.

When the vacuum cleaner 2 is turned on by pulling the trigger 24, the controller 50 supplies electrical power to the vacuum motor 52 at an initial power level. This is shown in block A. In this case the initial power level is 130 W.

As discussed above, when the trigger 24 is pulled the controller 50 also supplies electrical power to the agitator motor 54. In this embodiment, however, the controller 50 does not adjust the electrical power delivered to the agitator motor 54. Accordingly, the supply of power to the agitator motor 54 is not represented in FIG. 4.

After supplying electrical power to the vacuum motor 52 and agitator 54, the controller detects the current draw of the agitator motor 54 (block B). It then compares the measured value to the threshold range. More particularly, the controller 50 queries whether or not the detected current draw is larger than the threshold range (i.e. larger than 2 A), as shown in block C. If the detected current draw is above the current threshold then the controller 50 increases the electrical power delivered to the vacuum motor 52 from the initial power level to an upper power level (block D). In this case the upper power level is 180 W.

If the detected current draw is not larger than the threshold range, the controller again compares the detected current draw to the threshold, in this case querying whether or not the detected current draw of the agitator motor 54 is smaller than the threshold range (i.e. less than 1.5 A). This is shown in block E. If this is the case then the controller 50 decreases the electrical power delivered to the vacuum motor 52 from the initial power level to a lower power level (block F). In this embodiment the lower power level is 80 W.

If the detected current draw is neither above nor below the threshold (i.e. is between 1.5 A and 2 A) the controller 50 does not make an adjustment and continues to deliver the initial power level to the vacuum motor. Whether or not a power level adjustment is made after performing the above comparison(s) between the current draw and the threshold, the controller then implements a time delay (block G) before detecting the current draw of the agitator motor 54 again (block A). The time delay of this embodiment is 0.3 seconds. In other words the controller 50 monitors the current draw periodically with a time period of 0.3 seconds. In other embodiments, however, the time delay may be omitted so that the controller monitors the agitator motor 54 current draw continually (notwithstanding any negligible time delay caused by the controller implementing some of blocks B-F).

After the time delay has been performed (block G) and the agitator motor current draw measured (block B), the controller 50 compares the new value to the threshold (blocks C and E) again. If the measured value has the same position relative to the threshold range (i.e. above, below or within the threshold range) then no adjustment is made, the time delay (block G) is implemented and the cycle repeats again. However, if the measured current draw has changed position relative to the threshold then an adjustment may be made. For instance, if the current draw was previously within the threshold but had moved to above the threshold then the controller 50 would increase the power delivered to the vacuum motor from the initial power level to the upper power level. As another example, if the current draw was previously above the threshold but had moved to below the threshold then the controller 50 would decrease the power delivered to the vacuum motor 52 from the upper power level to the lower power level. If, on the other hand, the current draw was previously above or below the threshold but had then moved to within the threshold, no adjustment would be made and the power delivered to the vacuum motor 52 would remain at the same power level (i.e. the upper power level or lower power level).

Figure 4:
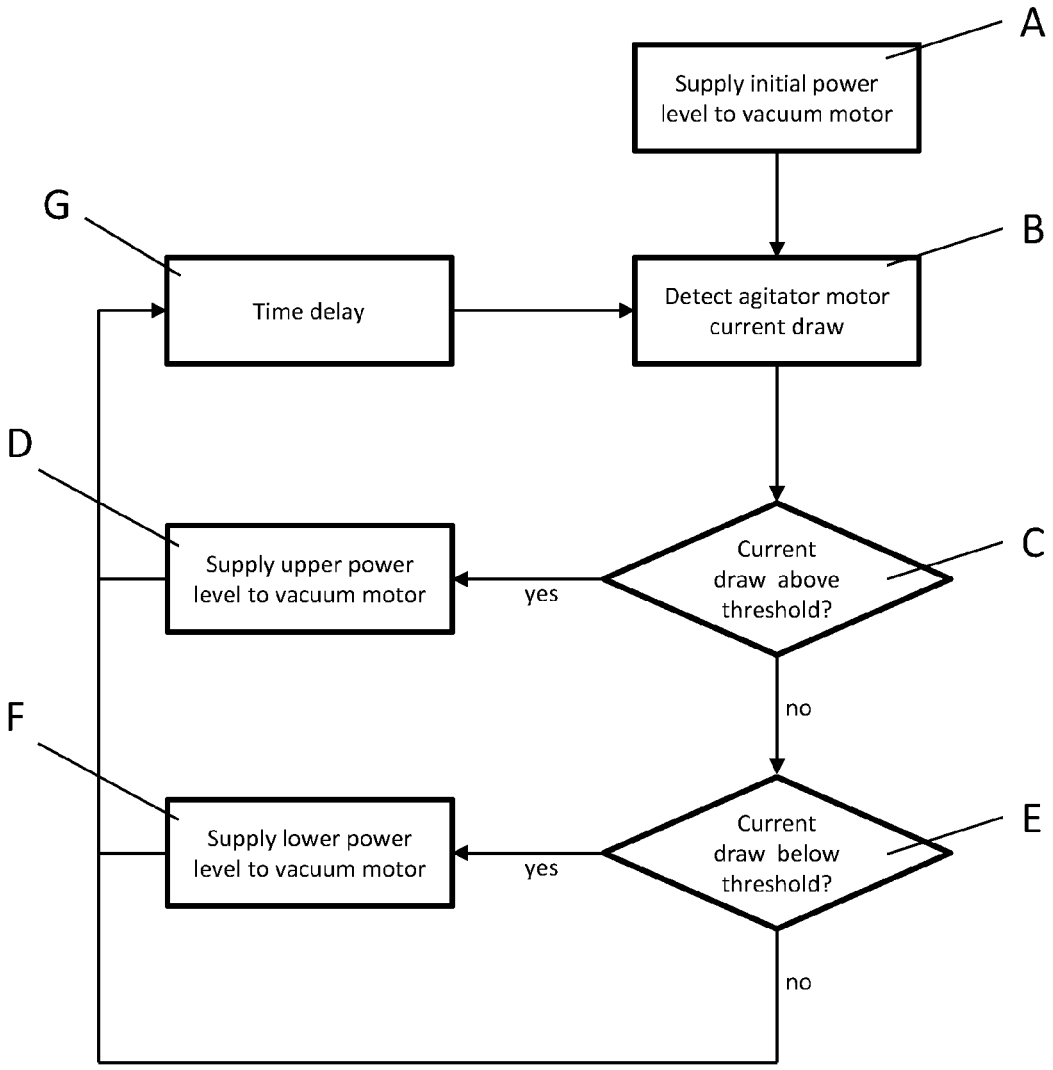
FIG. 4 is a schematic flow chart showing the control operations performed by a controller of the vacuum cleaner of FIG. 1.

It will be understood from FIG. 4 that as long as the current draw of the agitator motor 54 remains within the threshold after the machine is turned on, the power level delivered to the vacuum motor will be the initial power level. However, the threshold and power levels have been selected to make this scenario unlikely in practice. The controller 50 is expected to adjust the power level to the upper power level or lower power level relatively quickly (if not during the first cycle of the steps shown in FIG. 4). It will be understood that once the first adjustment to the power level has been made by the controller 50, the controller becomes set to supply to the vacuum motor 52 no other power level except the low power level and upper power level. In other words, it becomes set and will only supply either 80 W or 180 W to the vacuum motor 52.

It is noteworthy that in this embodiment, whenever the controller makes an adjustment to the power level supplied to the vacuum motor 52, it does so gradually rather than making a step change to the power level. More particularly, it adjusts the power level over a period of around two seconds. This avoids sudden changes to the speed of the vacuum motor 52 (resulting from sudden changes to the power supplied) which may confuse the user.

Figure 5:
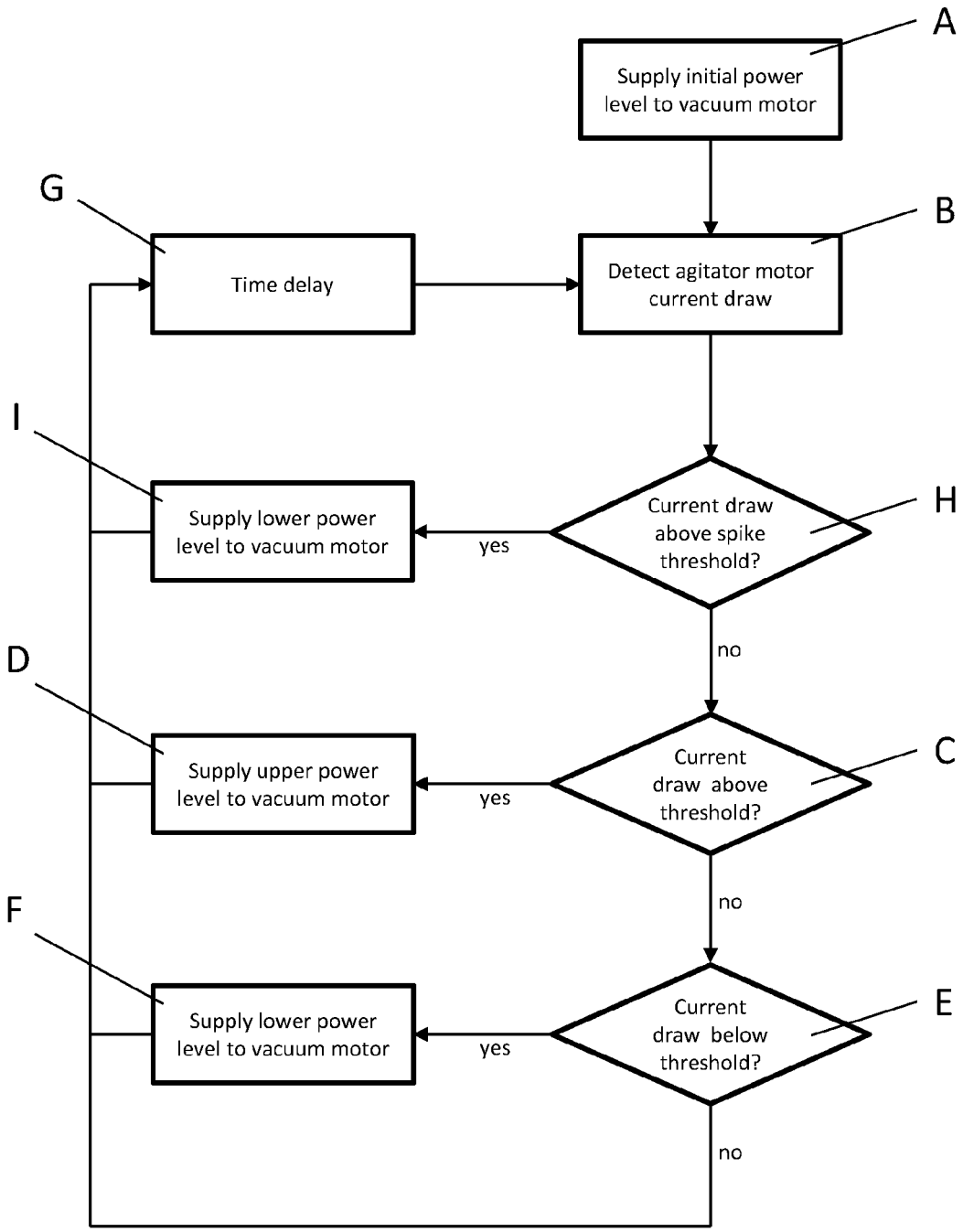
FIG. 5 is a schematic flow chart showing the control operations performed by a controller of a vacuum cleaner according to a second embodiment of the invention.

FIG. 5 is a flow chart showing the decision steps and actions performed by a controller of a vacuum cleaner according to a second embodiment of the invention. The second embodiment is generally the same as the first embodiment, therefore only the differences will be described here.

In the second embodiment, in each cycle the controller 50 compares the detected current draw of the agitator motor 54 to a spike threshold (block H), before the current draw is compared to the threshold described above (blocks C and E). In this case the spike threshold is a discrete value, namely 5 A. If the current draw exceeds the spike threshold (i.e. is more than 5 A) then the controller 50 decreases the electrical power delivered to the vacuum motor 52, in this case setting it to the lower power level (i.e. 80 W). This is shown in block I. Whereas the adjustments made in blocks D and F are gradual, the adjustment made in block I is stepwise—the power is dropped to the lower power level as rapidly as the controller can achieve.

After the power level has been adjusted in step I, the controller implements the time delay (block G) and then re-measures the current draw (block B), starting the cycle again. If the current draw was and remains above the spike threshold then the controller 50 will continue to deliver the lower power level to the vacuum motor 52 (as it will if the current draw drops from above the spike threshold to below the threshold (i.e. from above 5 A to below 1.5 A) during a single time delay period). However, if the current draw now lies between the threshold and the spike threshold then the controller 50 will deliver the upper power level to the vacuum motor 52.

For the avoidance of doubt, while the current draw of the agitator motor 54 remains below the spike threshold, the vacuum cleaner 2 of the second embodiment will behave in the same manner as that of the first embodiment.

Figure 6:
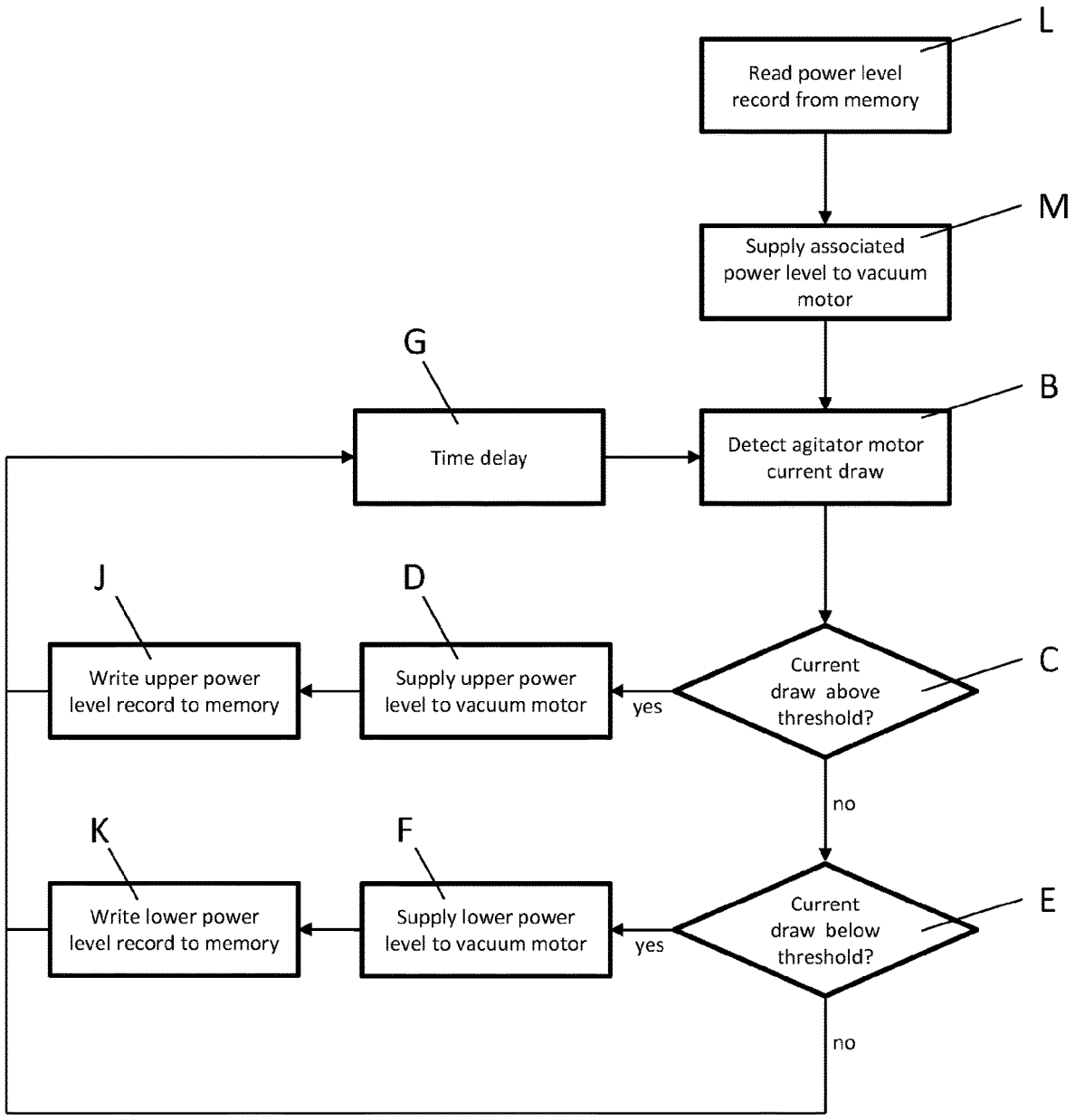
FIG. 6 is a schematic flow chart showing the control operations performed by a controller of a vacuum cleaner according to a third embodiment of the invention.

FIG. 6 is a flow chart showing the decision steps and actions performed by a controller of a vacuum cleaner according to a third embodiment of the invention. This embodiment is also similar to the first embodiment, therefore again only the differences will be described here.

In this embodiment the controller 50 includes a memory in which it stores a record of the power level which was being delivered to the vacuum motor 52 when the vacuum cleaner 2 was last turned off. Further, rather than delivering an initial power level to the vacuum motor 52 when the vacuum cleaner 2 is first turned on, the controller 50 delivers the power level which was being delivered when the vacuum cleaner was last turned off.

Whenever the controller 50 makes an adjustment, it writes (or overwrites) into the memory a record of the power level which is now being delivered (blocks J and K). Thus, when the vacuum cleaner 2 is turned off the memory will contain a record of the last power level which was set (either the upper power level or the lower power level). When the vacuum cleaner 2 is turned on again, the controller retrieves that record from the memory (block L) and delivers the associated power level to the vacuum motor 52 (block M).

Since in this embodiment the controller 50 delivers either the upper power level or the lower power level straight away, rather than delivering an initial power level, the controller can be considered to be pre-set to supply to the vacuum motor 52 no other power level except the low power level and upper power level.

That being said, in the third embodiment the behaviour of the controller discussed above only takes place when the controller is in a first mode. The controller 50 also has a second mode which is a 'min' mode, and a third mode which is a 'max' mode. When the controller 50 is in the min mode it supplies to the vacuum motor 52 a constant power level which is below the lower power level (in this case 70 W). Similarly, when the controller 50 is in the max mode it supplies to the vacuum motor 52 a constant power level which is above the upper power level (in this case 190 W). The mode of the controller 50 can be set using a three-position slider switch 58 on the main body 6, an example of which is visible in FIG. 1.

It will be appreciated that numerous modifications to the above described embodiments may be made without departing from the scope of invention as defined in the appended claims. For instance, in a modification of the third embodiment the power level delivered to the vacuum motor 52 when the controller 50 is in min mode may be above the lower power level (for instance 90 W) and/or the power level delivered to the vacuum motor 52 when the controller 50 is in max mode may be below the upper power level (for instance 170 W).

The invention claimed is:

1. A vacuum cleaner comprising:

a cleaner head defining a suction chamber and having an agitator arranged to be rotated by an agitator motor;

a dirt separator;

a vacuum motor arranged to draw air into the suction chamber and then into the dirt separator; and a controller configured to selectively operate in a first mode, a second mode, and a third mode, wherein while in the first mode, the controller is configured to:

monitor an electrical load of the agitator motor, compare a magnitude of the electrical load to a threshold range, and selectively adjust the electrical power delivered to the vacuum motor, wherein the controller is configured to at least one of: gradually increase the electrical power delivered to the vacuum motor to a predetermined upper power level when the electrical load is greater than an upper limit of the threshold range, and gradually decrease the electrical power delivered to the vacuum motor to a predetermined lower power level, that is greater than zero, when the electrical load is smaller than a lower limit of the threshold range, wherein the controller is configured to retain a record of the power level that was being delivered to the vacuum motor when the vacuum cleaner was last turned off, and is configured to resume delivery of that power level to the vacuum motor when the vacuum cleaner is next turned on, and compare the magnitude of the electrical load to a spike threshold, which is higher than the upper limit of the threshold range, wherein the controller is configured to provide a rapid step decrease in the power delivered to the predetermined lower power level in response to determining that the electrical load is larger than the spike threshold, initiate a time delay, and following the expiration of the time delay, compare the magnitude of the electrical load to the spike threshold to determine whether the electrical load remains larger than the spike threshold, wherein while in the second mode, the controller is configured to supply a minimum predetermined power level to the vacuum motor, the minimum predetermined power level being below the predetermined lower power level and greater than zero, and wherein while in the third mode, the controller is configured to supply a maximum predetermined power level to the vacuum cleaner when the controller is in the third mode, the maximum predetermined power level being above the predetermined upper power level.

2. The vacuum cleaner of claim 1, wherein the controller is configured both to increase the power delivered to the vacuum motor to the upper power level when the electrical load is greater than the upper limit of the threshold range, and to decrease the power delivered to the vacuum motor to the lower power level when the electrical load is smaller than the lower limit of the threshold.

3. The vacuum cleaner of claim 2, wherein the controller can be set to supply to the vacuum motor no other power level except the upper power level and the lower power level.

4. The vacuum cleaner of claim 2, wherein the controller is configured to continue monitoring the electrical load of the agitator after making an adjustment to the power delivered to the vacuum motor, and to make a further adjustment upon detecting that the electrical load of the agitator motor has crossed over one of the upper or lower limit of the threshold.

5. The vacuum cleaner of claim 1, wherein the controller is configured to monitor the agitator motor electrical load in terms of current draw of the electrical motor, and compare the current draw detected to a current threshold range having an upper current threshold and a lower current threshold.

6. The vacuum cleaner of claim 1, wherein the controller is configured to deliver a predetermined initial power level, which does not correspond to the upper power level or the lower power level, to the vacuum motor when the vacuum cleaner is turned off and then on again.

7. The vacuum cleaner of claim 1, where the controller is configured to adjust the power delivered to the vacuum motor to the upper or lower power level over a time of at least 0.5 seconds.

8. The vacuum cleaner of claim 1, wherein the controller is configured to adjust the power delivered to the vacuum motor to the upper or lower power level over a time of no more than 6 seconds.

9. The vacuum cleaner of claim 1, wherein the upper and lower limits of the threshold range are discrete values.

10. The vacuum cleaner of claim 1, wherein the vacuum cleaner is a handheld vacuum cleaner comprising:

a main body including:

the dirt separator, the vacuum motor, and a handle having an on/off switch in the form or a trigger, the on/off switch configured to activate the vacuum motor when the trigger is compressed and deactivate the vacuum motor when the trigger is released.

11. The vacuum cleaner of claim 1, wherein the vacuum cleaner is a stick vacuum cleaner comprising:

a main body including:

the dirt separator, the vacuum motor, and a handle having an on/off switch in the form of a trigger, the on/off switch configured to activate the vacuum motor when the trigger is compressed and deactivate the vacuum motor when the trigger is released; and an elongate wand connecting the main body to the cleaner head.

12. The vacuum cleaner of claim 1, wherein the threshold range includes a buffer range that is less than the upper limit and greater than the lower limit such that the controller does not increase or decrease the electrical power delivered to the vacuum motor due to fluctuations of the electrical load that fall within the buffer range.

* * * * *